US007001156B2

(12) United States Patent
Chen

(10) Patent No.: US 7,001,156 B2
(45) Date of Patent: Feb. 21, 2006

(54) STRUCTURE OF AN AIR INFLATION DEVICE

(76) Inventor: Chih-Ming Chen, PO Box 82-144, Hsin-Tien (TW)

( * ) Notice: Subject to any disclaimer, the term of this patent is extended or adjusted under 35 U.S.C. 154(b) by 0 days.

(21) Appl. No.: 10/153,772

(22) Filed: May 24, 2002

(65) Prior Publication Data

US 2003/0219348 A1 Nov. 27, 2003

(51) Int. Cl.
*F04B 17/03* (2006.01)

(52) U.S. Cl. ..... 417/366; 417/559; 417/569; 417/371; 417/313; 55/467; 55/471; 55/502

(58) Field of Classification Search ..... 310/89, 310/52, 55, 56, 59, 88; 417/366, 371, 313, 417/415, 545, 550, 555.1, 559, 569; 92/78; 55/467, 471, 505, 502
See application file for complete search history.

(56) References Cited

U.S. PATENT DOCUMENTS

| | | | | | |
|---|---|---|---|---|---|
| 3,645,651 | A * | 2/1972 | Bills | 417/479 |
| 3,961,868 | A * | 6/1976 | Droege et al. | 417/550 |
| 4,399,378 | A * | 8/1983 | Krumm et al. | 310/56 |
| 4,789,310 | A * | 12/1988 | Hung | 417/234 |
| 4,836,755 | A * | 6/1989 | Nitsche et al. | 417/368 |
| 5,567,128 | A * | 10/1996 | Volz et al. | 417/313 |
| 5,584,675 | A * | 12/1996 | Steurer et al. | 417/372 |
| 6,283,390 | B1 * | 9/2001 | Brendle et al. | 239/533.2 |
| 6,648,612 | B1 * | 11/2003 | Hsiao | 417/313 |
| 2001/0014290 | A1 * | 8/2001 | Takura et al. | 417/371 |

* cited by examiner

*Primary Examiner*—Timothy S. Thorpe
*Assistant Examiner*—Emmanuel Sayoc
(74) *Attorney, Agent, or Firm*—Leong C. Lei

(57) ABSTRACT

An improved structure of an air inflation device is disclosed. External air is drawn to the motor and cylinder to provide rapid cooling so that the efficiency of the motor is maintained. In the present invention, a plurality of air filters is used to filter air. Thereby the air inflation device is useful and practical.

3 Claims, 5 Drawing Sheets

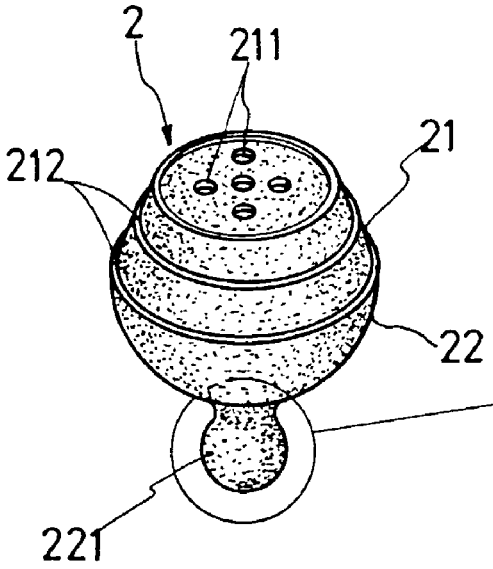
FIG.4
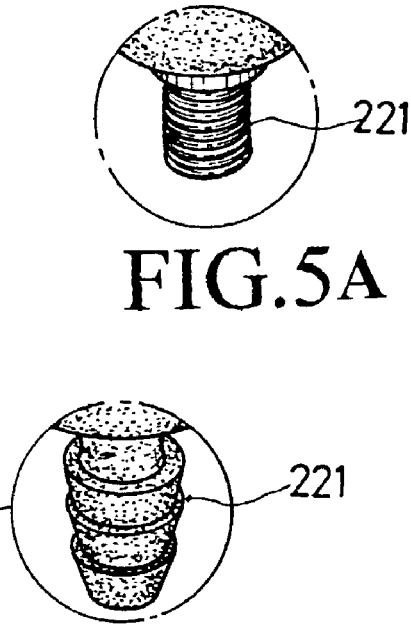
FIG.5A
FIG.5
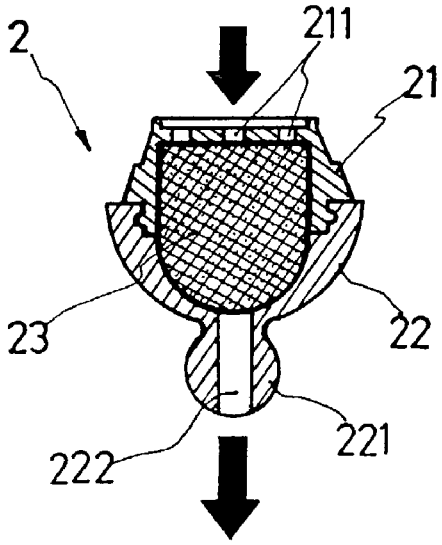
FIG.6

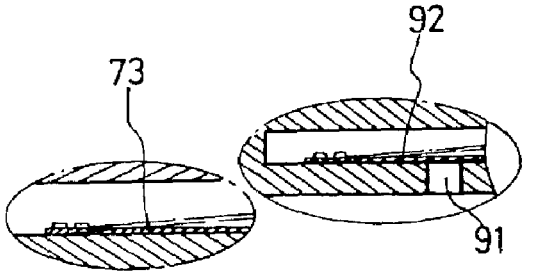
FIG.9
FIG.8
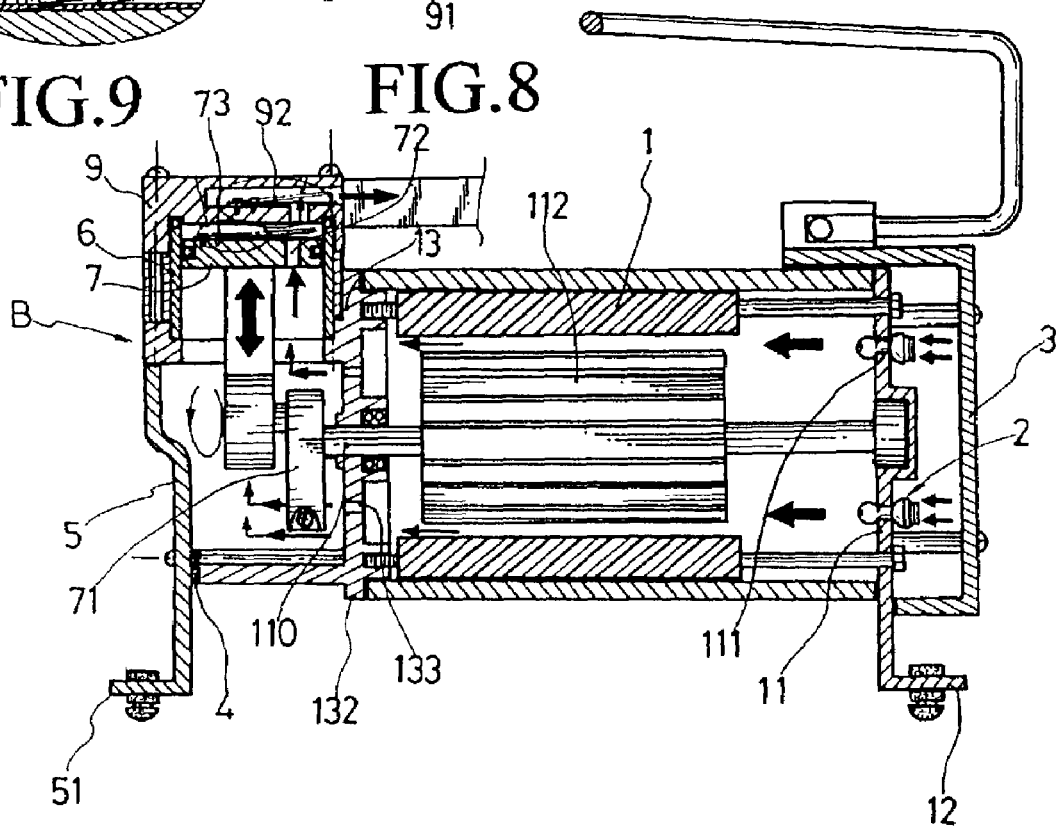
FIG.7

STRUCTURE OF AN AIR INFLATION DEVICE

BACKGROUND OF THE INVENTION

1. Field of the Invention

The present invention relates to an air inflation device, and in particular, an inflation device which draws air externally and cool the air cylinder and the motor.

2. Description of the Prior Art

Conventional DIY air inflation device has the drawbacks of insufficient inflation pressure, and excessive noise. FIG. 1 shows a conventional mini size air inflation device A1 that can solve the drawback of excessive noise. However, the heat dissipated by the motor in the course of operation has affected seriously the efficiency of the motor. In other words, this conventional air inflation device has a very short live of use. Besides, in the course of operation of the air inflation device, heat dissipation to the motor is not provided to the motor and the cylinder. In some cases, the excessive heat and current overload will damage the socket for cigarette lighter within the vehicle. Accordingly, it is an object of the present invention to provide an improved structure of an inflation device, which mitigates the above drawbacks.

SUMMARY OF THE PRESENT INVENTION

The present invention relates to an air inflation device, and in particular, an inflation device which draws air externally and cool the air cylinder and the motor.

Accordingly it is a main object of the present invention to provide an improved structure of an inflation device having a motor, a mini-sized button-type air filter, a front mounting seat, a muffling pad, a muffling board seat, an air cylinder mounting, a piston, a cylinder body, an cylinder cover and a pressure gauze, characterized in that the motor has a sealing mounting seat provided with one or more than one through hole disposed with the air filter, the front mounting seat is locked with a covering cap, and a cylinder seat mounting plate of the motor is also provided with a through hole to lead air into the cylinder body, and the piston within the cylinder body is connected to the main shaft of the motor so that reciprocation movement is obtained, the piston is provided with an air-inlet hole and the top of the air-inlet hole is provided with an air-sealing pad, and an air discharge hole is provided within the interior of a through slot of the cylinder cover and the top face of the air discharge hole is also provided with a sealing pad, thereby when the reciprocating movement is initiated, air inflation is obtained and the motor and the cylinder body are provided with cooling air.

Another object of the present invention is to provide an improved structure of an inflation device, wherein the device is provided with excellent heat dissipation so that the excessive heat caused the burning of the motor is mitigated.

Yet another object of the present invention is to provide an improved structure of an air inflation device, wherein the cost of manufacturing is low and the longevity of the device is extended.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 4 is a perspective view of the air filter in accordance with the present invention.

FIG. 5 is another preferred embodiment of air filter in accordance with the present invention.

FIG. 5A is another preferred embodiment of an air filter in accordance with the present invention.

FIG. 6 is a sectional view of the air filter in accordance with the present invention.

FIG. 7 is a sectional view of the present invention.

FIG. 8 is a sectional enlarged view of the air discharging sealing pad of the present invention.

FIG. 9 is a sectional enlarged view of the air inlet sealing pad of the present invention.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
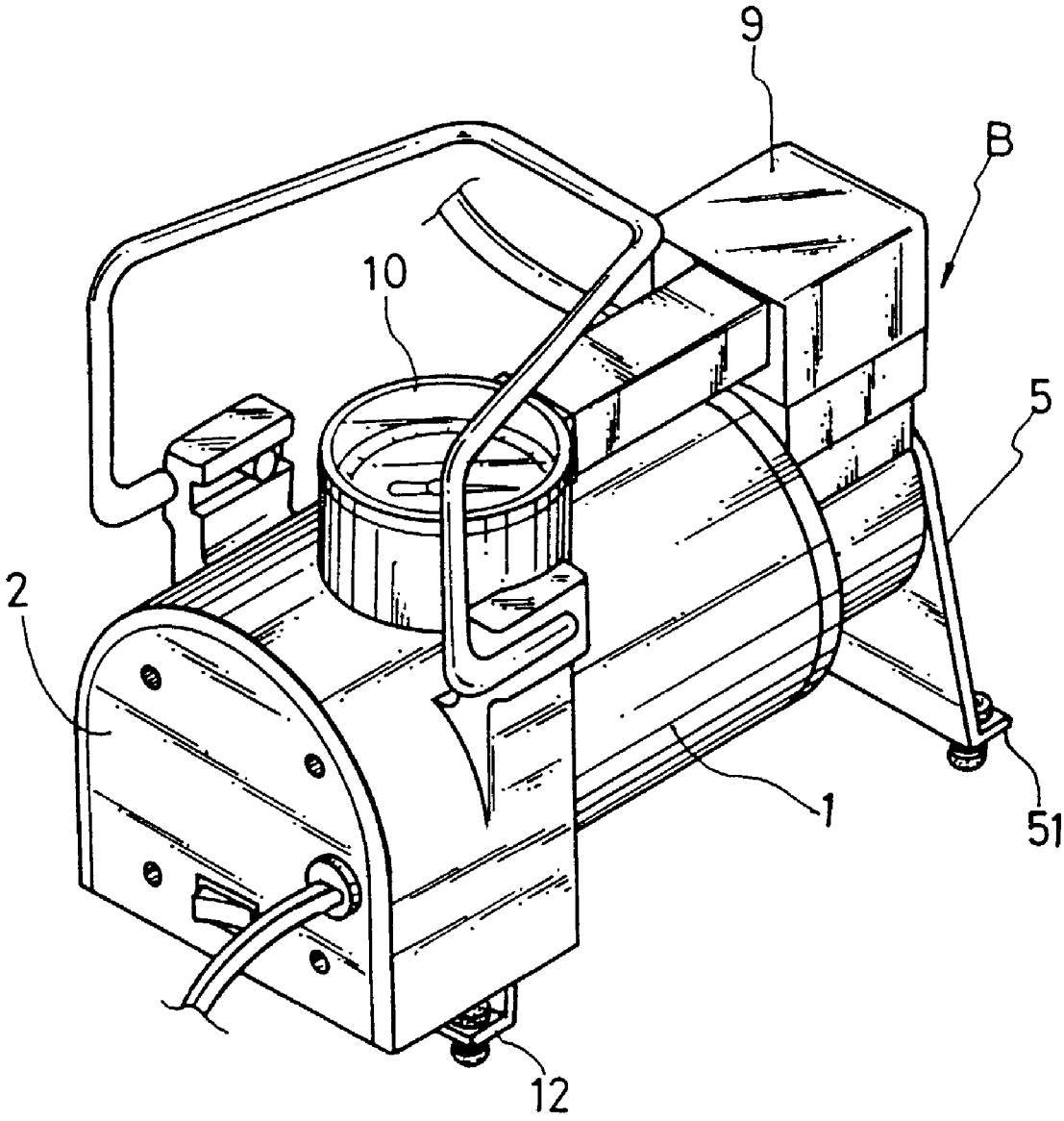
FIG. 2 is a perspective view of a preferred embodiment of the present invention.
Figure 3:
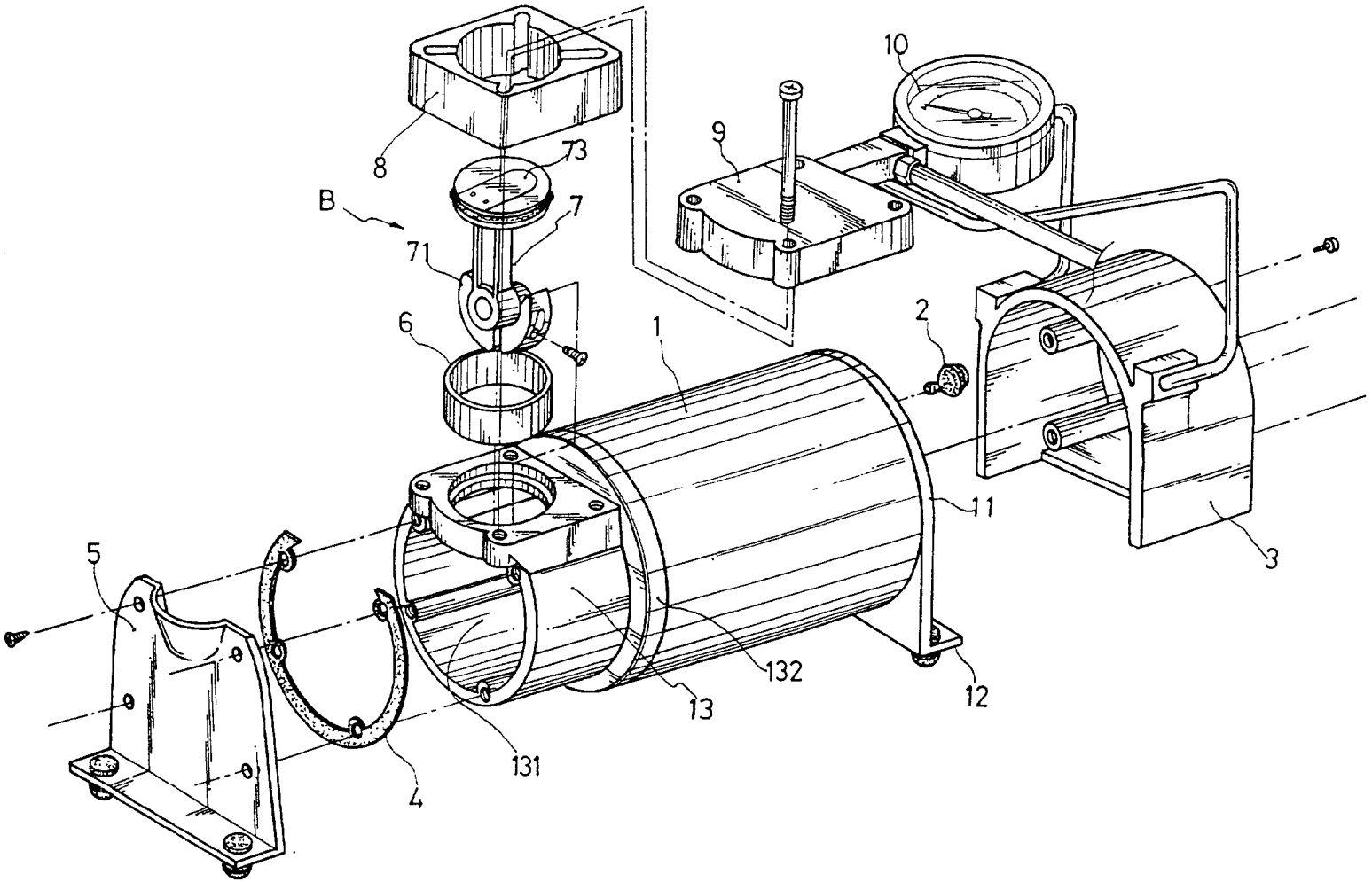
FIG. 3 is a perspective exploded view of the various parts of the present invention.

Referring to FIGS. 2 and 3 there is shown an improved structure of an air inflation device comprising a motor 1, a mini-sized button-type air filter 2, a front mounting seat 3, a muffling pad 4, a muffling board seat 5, an air cylinder mounting 6, a piston 7, a cylinder body 8, an cylinder cover 9 and a pressure gauze 10, characterized in that the motor 1 has a sealing mounting seat 11 for sealing the opening at the rear of the motor 1. The mounting sear 11 is extended to a bottom-bending leg seat 12. The motor 1 is provided with forward opening which is directly shut by the air cylinder seat 13 at the front opening of the motor 1 such that the motor and the air cylinder seat 13 are combined as one unit. The sealing mounting seat 11 of the motor 1 is provided with one or more than one through hole 111 disposed with the air filter 2, allowing external air to be withdrawn. The cylinder seat locking plate 132 is provided with through holes 133 of equal number and the through hole 133 can directly communicate with the cylinder body B so as to draw air. This is shown in FIG. 7.

As shown in FIGS. 2 and 3, the opening end 131 of the cylinder seat 13 is provided with a muffling plate seat 5 having mounted with a muffling pad 4 to seat off the opening end 131. The muffling end 5 is provided with bended leg seat 51 so as to correspond to the leg seat 12 of the sealing mounting seat. The top section of the cylinder 13 is provided with an air cylinder mounting 6, pistons 7, cylinder body 8 and cylinder cover 9 to form into an entire cylinder body B. The piston 7 has an eccentric block 71 connected to the main shaft 110 such that the piston 7 can form reciprocation movement within the cylinder body B. The lateral side of the air cylinder cover 9 is mounted with pressure gauze 10 to show the pressure reading.

As shown in FIGS. 8 and 9, the piston 7 within the cylinder body B is connected to the main shaft 110 of the motor 1 so that reciprocation movement is obtained. The piston 7 is provided with an air-inlet hole 72 and the top of the air-inlet hole 72 is provided with an air-inlet sealing pad 73, and an air discharge hole 91 is provided within the interior of a through slot of the cylinder cover 9 and the top face of the air discharge hole 91 is also provided with an air-discharge sealing pad 92.

When the motor 1 is in operation, the rapid rotation of the rotor 112 provides turbulent air and together with the rapid reciprocation movement of the piston 7, the absorbing force that produced will lead air passed through the motor 1 to the cylinder B so as to obtain heat dispersion effect. When the piston 7 moves downward, the pressure that produced at that instance pushes the air inlet sealing pad 73 and the air is lead to the cylinder mounting 6. When the piston 7 moves upward the compressed will push away the air discharge sealing pad 92 at the air inlet hole 91. At this instance the sealing pad 73 is in a sealing status and the compressed air can be rapidly discharged away. Thereby when the reciprocating movement is initiated, air inflation is obtained and the motor and the cylinder body are provided with cooling air. Therefore the operation capability of motor is lengthened.

Figure 1:
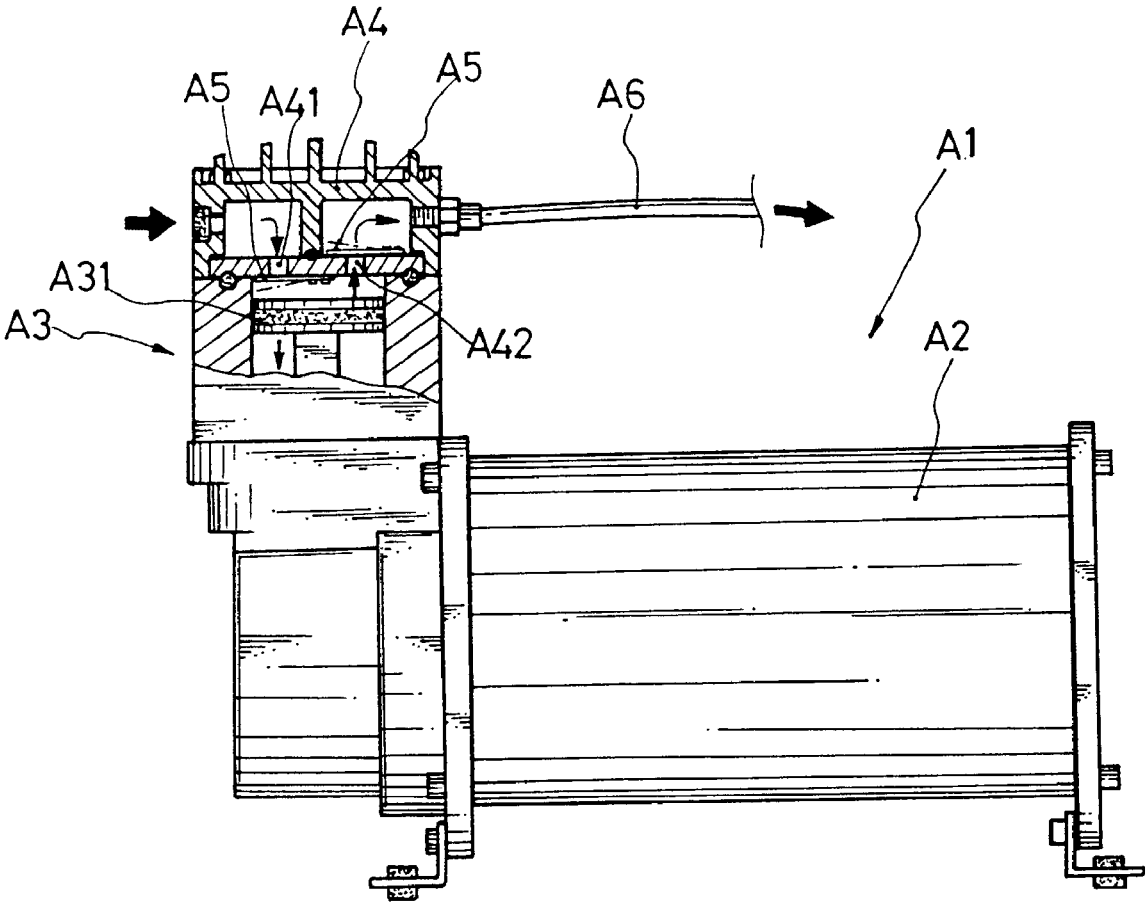
FIG. 1 is a plan and partial sectional view of a conventional air inflation device.

Referring to FIGS. 4, 5 and 5A, the air filter 2 is positioned at the through hole 111 of the sealing mounting seat to provide leading external air for heat dispersion. The external of the installed filter 2 is locked and covered by the front mounting seat 3 such that the air filter 3 is concealed and hidden. In accordance with the present invention, the air filter 2 includes a top cover 21 and a cup body 22 and the face of the top cover 21 is provided with air holes 211 and the outer circumferential edge is provided with a water sealing edge 212 to prevent water drops into the air holes 211. The cup body 22 is provided with an insertion section 221 and an air communication slot 222 for filling of air filtering material 23 for air purification. Referring to FIGS. 5 and 5-1, the insertion section is provided with a snap engagement or a screw-typed lock. These mounting methods are of similar function.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of a mini-sized air-inflation device having a motor, a mini-sized button-type air filter, a front mounting seat, a muffling pad, a muffling board seat, an air cylinder mounting, a piston, a cylinder body, an cylinder cover and a pressure gauze, characterized in that:

the motor has a sealing mounting seat provided with one or more than one through hole disposed with the air filter, the front mounting seat is locked with a covering cap, and a cylinder seat mounting plate of the motor is also provided with a through hole to lead air into the cylinder body, and the piston within the cylinder body is connected to the main shaft of the motor so that reciprocation movement is obtained, the piston is provided with an air-inlet hole and the top of the air-inlet hole is provided with an air-sealing pad, and an air discharge hole is provided within the interior of a through slot of the cylinder cover and the top face of the air discharge hole is also provided with a sealing pad, thereby when the reciprocating movement is initiated, an inflation is obtained and the motor and the cylinder body are provided with cooling air, wherein the air filter is positioned within the through hole of the sealing mounting seat for leading air from the outside for dissipation, the air filter includes a top cover and a cup body and the face of the top cover is provided with air holes and the outer circumferential edge is provided with a water sealing edge and the cup body is provided with an insertion section and an air communication slot for filling of air filtering material.

2. The structure of claim 1, wherein the insertion section is provided with a snap engagement or a screw-typed lock.

3. The structure of claim 1, wherein the air filter is directly connected to the through hole provided on the muffling plate seat, directly cooling the interior of the cylinder body.

* * * * *